US005132886A

United States Patent [19]

Hoag et al.

[11] Patent Number: 5,132,886

[45] Date of Patent: Jul. 21, 1992

[54] FLUORESCENT STRAP LIGHT WITH HINGED COVER

[75] Inventors: William E. Hoag, Redding, Conn.; Raymond G. Falci, College Point, N.Y.

[73] Assignee: ML Systems, Edison, N.J.

[21] Appl. No.: 718,197

[22] Filed: Jun. 20, 1991

[51] Int. Cl.[5] ..... F21V 23/02

[52] U.S. Cl. ..... 362/221; 362/260

[58] Field of Search ..... 362/221, 260, 217, 362, 362/282, 322

[56] References Cited

U.S. PATENT DOCUMENTS 3,096,028 7/1963 Harling ..... 362/260 X 4,977,490 12/1990 Davies ..... 362/221

FOREIGN PATENT DOCUMENTS 500247 3/1954 Canada ..... 362/221

*Primary Examiner*—Stephen F. Husar

*Attorney, Agent, or Firm*—Elroy Strickland

[57] ABSTRACT

A strip lighting fixture having a hollow base structure and a cover for closing an open face of the structure. At least one bracket member is mounted in the base structure, and a hinge arm is rotatably attached to the bracket member so that the cover can be rotated away from the base structure. In addition, at least one pin is provided for maintaining the cover in a substantially 90° relation to the plane of the base structure when the cover is rotated from the base structure.

7 Claims, 1 Drawing Sheet

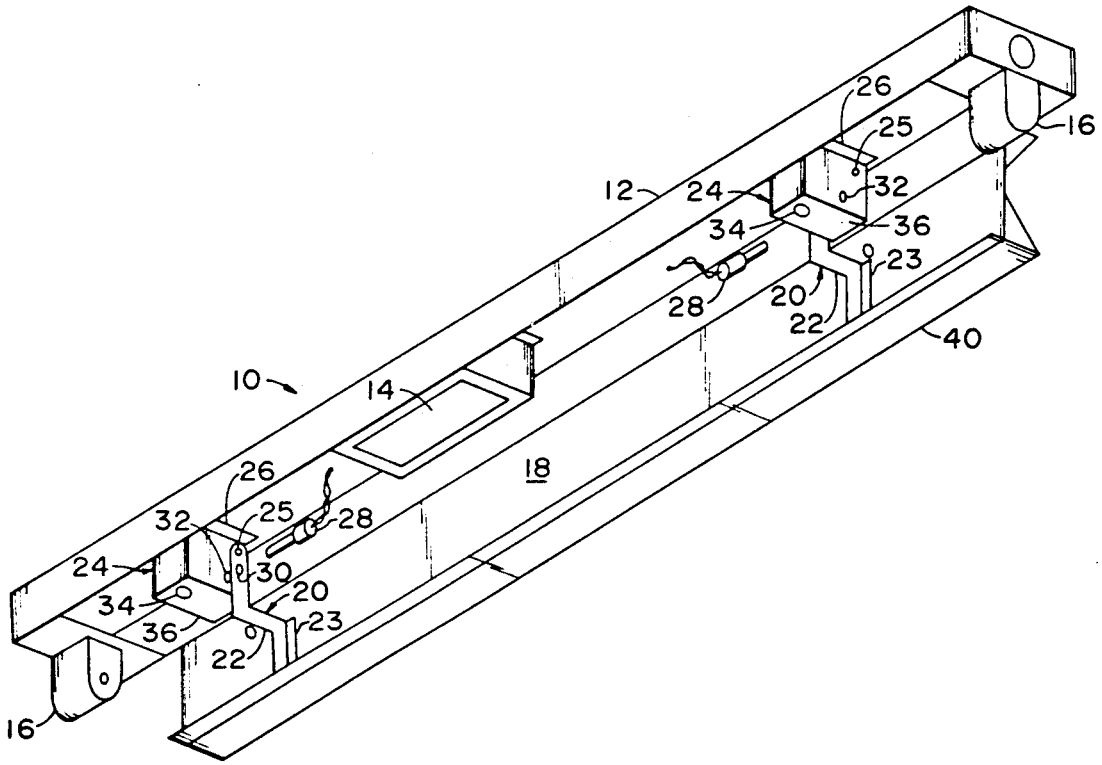
26
25
16
12
24
32
34
36
23
28
20
22
40
10
14
18
26
25
32
28
24
30
20
34
23
36
22
16

FLUORESCENT STRAP LIGHT WITH HINGED COVER

BACKGROUND OF THE INVENTION

The present invention relates generally to overhead fluorescent light fixtures and more particularly to elongated strip-like fluorescent light fixtures that are used in-line to provide long lines or strips of light over large open areas, as in large stores and warehouses.

A fluorescent light fixture includes a hollow base structure that contains a ballast and associated wires that extend between the ballast and fluorescent tube sockets and, of course, connect the components to a source of A/C voltage. Over the base is located a cover that encloses the ballast and wiring, the cover extending between the fluorescent tube sockets.

When it becomes necessary to remove the ballast and replace it with a new one the fluorescent tube is removed from the sockets and the cover is removed to gain access to the ballast. After the ballast is replaced, the cover is replaced and the fluorescent tube inserted again between the sockets.

In large stores and industrial buildings, there are often hundreds of such lights that form strips of light on or near the ceilings of such stores and buildings. The ceilings of the buildings are often high so that tall step ladders are used by personnel to reach the fixtures to service them. In the process, a person climbs the ladder, removes the tube and descends the ladder to lay the tube aside. He then ascends the ladder again, removes the cover and again, descends the ladder to lay aside the cover. He then ascends the ladder one more time to remove the old ballast and to install the new one. After the new ballast is installed, the process of again descending and ascending the ladder to return the cover and tube to the fixture takes place.

It can be appreciated that with the use of large numbers of fluorescent fixtures, the amount of effort (labor) required to service the fixtures is substantial. Any solution to this problem is appreciated as it saves substantial time and labor.

BRIEF SUMMARY OF THE INVENTION

The present invention is directed to strip-like fluorescent tube fixtures provided with covers that are hinged to the bases of the fixtures so that the covers can be simply rotated away from the base after the fluorescent tube is removed from the fixture. The invention includes a simple hinge construction that is inexpensive to make, is easy to assemble and allows the base to be completely opened, and to remain open, while an old ballast is removed and a new one installed.

The hinge of the invention allows the cover to rotate 90° from the plane of the base. A simple pin means is provided to retain the cover in its 90° rotational position. When the installer has finished his task, he removes the pin from its retaining position, closes the cover on the base, and reinstalls the fluorescent tube.

The hinge of the invention employs a bracket that, in addition, serves as a means to receive and secure a quarter-turn fastener held captive in the cover. The fastener and bracket secure the cover in a closed position on the base.

THE DRAWING

The invention, along with its advantages and objectives, will be better understood from consideration of the following detailed description and the accompanying drawing, the sole FIGURE which is a perspective view of the fluorescent fixture of the invention, with the cover of the fixture shown in an "open" position, as provided by the hinges of the invention.

PREFERRED EMBODIMENT

Referring now to the FIGURE of the drawing, a narrow strip fluorescent tube light fixture 10 is shown in perspective. The fixture includes a base 12 that contains a ballast 14 (and associated wiring not shown), two opposed sockets 16 for receiving the contact pins of a single fluorescent tube (not shown) and a cover 18 hinged to the base in a manner presently to be explained. The length of cover 18 is such that it will pass between sockets 16 when it is rotated relative to base 12.

Fixture 10 is shown in the FIGURE with cover 18 rotated into an "open" position, which position is permitted and provided by two hinge means 20 located towards the respective ends of the fixture. Each hinge means includes a "dog leg" or double L arm 22, one end of which is suitably attached and fixed to the inside surface of cover 18. The end of the arm inside of the cover can, for example, be provided with an integral flange 23 that is easily, attached to the inside of the cover.

The other end of arm 22 is pivotably connected to a U-shaped bracket 24 at location 25. A simple pin, not otherwise visible in the FIGURE except at 25, can be used to rotatably attach arm 22 to bracket 24. Such a pin can be captured in the bracket and arm in any suitable manner.

Brackets 24 are attached to the inside surface base 12. In the FIGURE, each bracket is shown provided with opposed, outwardly directed flanges 26 that can easily be attached to the base; only one flange of each bracket is visible in the FIGURE.

Arms 22 and brackets 24 can be simple planar metal stampings so that the cost of the hinges 20 of the invention is not substantial yet is quite sufficient in providing rotation of cover 18 from base 12 without detaching the cover from the base so that maintenance personnel need not carry the cover up and down a step ladder in servicing fixture 10.

The shape of arm 22 allows full, 90 degree opening of cover 18. Such an open position can be maintained by the use of a simple pin 28 and openings 30 and 32 provided respectively in arm 22 and bracket 24. (Two such pins are shown in the FIGURE, one for each bracket.) When the cover is rotated to a position about 90 degrees from the base, openings 30 and 32 are aligned so that pins 28 can be easily manually inserted into the openings. Since each bracket is fixed to the base the pin becomes fixed when it enters opening 32 to maintain the cover in an open position until the pin is removed from 32.

Each pin 28 can be conveniently and suitably loosely connected to base 12 so that it is available for use when the cover is opened.

When the serviceman has completed the task of replacing ballast 14 or other tasks that require access to the inside of base 12, he simply removes pins 28 from openings 30 and 32 and rotates the cover to a closed position over the base. With the pins suspended from inside of the base, the cover will receive them when rotated towards the base, storing them inside the cover until the cover is again rotated from the base.

Brackets 24, in addition to serving a means for pivoting the cover and for securing the cover in an open position, can also serve as a means to secure the cover in a closed position against the base. As seen in the FIGURE, each bracket is provided with an oblong opening 34 in a downwardly facing wall 36 of the bracket. At two corresponding locations in the cover are located two quarter-turn fasteners, which are well known, that extend into the openings 32 when the cover is closed on the base. A quarter turn or rotation of the fasteners in the openings secures the fastener in its respective opening and thereby secures the cover in place on the base.

A reflector 40 is shown attached to the outside surface of cover 18 in the FIGURE. Such a reflector enhances substantially the amount of light reaching the area to be illuminated by fixture 10. Preferably, the reflector is made of aluminum material with its outwardly (downwardly) facing surface brightly anodized to provide enhanced reflection of light energy produced by the fluorescent tube of fixture 10.

While the invention has been described in terms of preferred embodiments, the claims appended hereto are intended to encompass all embodiments which fall within the spirit of the invention.

What is claimed is:

1. A strip lighting fixture comprising:

a hollow base structure, tube sockets, wiring and at least one ballast secured in said hollow base structure, a cover for closing an open face of said base structure, at least one bracket means located on said base structure, a hinge arm rotatably attaching said cover to said bracket means about an axis extending in the direction of the fixture, and means for maintaining said cover in an open position when the cover is rotated from the open face of said base structure, thereby maintaining the wiring and ballast in an exposed condition for removal of the ballast from the hollow base structure and installation of a replacement ballast in the hollow base structure.

2. The fixture of claim 1 in which the hinge arm is a simple, planar member that extends between the bracket member and cover, and is pivotably connected to said bracket means.

3. The fixture of claim 1 in which the hinge arm is a stamped, metal item.

4. A strip lighting fixture comprising:

a hollow base structure, a cover for closing an open face of said base structure, at least one bracket means located on said base structure, a hinge arm rotatably attaching said cover to said bracket means, and means for maintaining said cover in an open position rotated from the open face of said base structure in a substantially ninety degree relation to the base structure, the means for maintaining the cover in ninety degree relation to the base structure including:

an opening provided in both the bracket means and hinge arm, said openings being aligned when the cover is rotated to a substantially ninety degree relation to the base structure, and a pin sized to be manually inserted into the aligned openings.

5. The fixture of claim 4 in which the bracket means is provided with a second opening that faces the cover when the cover is closed on the base structure, with the cover containing a quarter turn fastener for entering the second opening and for securing the cover in a closed position on the base structure when said fastener is turned in said second opening.

6. The fixture of claim 4 in which bracket means is a stamped metal item.

7. The fixture of claim 4 in which the bracket means is a hollow, generally U-shaped structure.

* * * * *

UNITED STATES PATENT AND TRADEMARK OFFICE

CERTIFICATE OF CORRECTION

PATENT NO. : 5,132,886

DATED : July 21, 1992

INVENTOR(S) : William E. Hoag et al

It is certified that error appears in the above-identified patent and that said Letters Patent is hereby corrected as shown below:

In the Title: Change "STRAP" to --STRIP--.

Col. 1, line 1 Change "STRAP" to --STRIP--.

Signed and Sealed this

Tenth Day of August, 1993

*Attest:*

Michael K. Kirk

MICHAEL K. KIRK

*Attesting Officer*

*Acting Commissioner of Patents and Trademarks*